US006366007B1

(12) United States Patent
Cheng

(10) Patent No.: US 6,366,007 B1
(45) Date of Patent: Apr. 2, 2002

(54) SPARK PLUG HAVING TAPERED GROUND ELECTRODE

(76) Inventor: Chen Hsiang Cheng, No. 29-194, Jian Nan, Jian Nan Li, Jia Li Chen, Tainan Hsien (TW)

( * ) Notice: Subject to any disclaimer, the term of this patent is extended or adjusted under 35 U.S.C. 154(b) by 0 days.

(21) Appl. No.: 09/435,679

(22) Filed: Nov. 8, 1999

(51) Int. Cl.[7] ..... H01T 13/20
(52) U.S. Cl. ..... 313/141; 313/142
(58) Field of Search ..... 313/140, 141, 313/142

(56) References Cited

U.S. PATENT DOCUMENTS 4,700,103 A * 10/1987 Yamaguchi et al. ..... 313/141
5,650,687 A * 7/1997 Van Den Bogaert ..... 313/141
5,821,676 A * 10/1998 Atchinson, II et al. ..... 313/141

FOREIGN PATENT DOCUMENTS

JP 09260025 A * 10/1997 ..... 313/141
JP 11121142 A * 10/1997 ..... 313/141

* cited by examiner

*Primary Examiner*—Ashok Patel
(74) *Attorney, Agent, or Firm*—Charles E. Baxley

(57) ABSTRACT

An improved structure of an ignition sparking plug having a grounding electrode and a central electrode is disclosed. The grounding electrode has a tip end with respect to the central electrode so that the only a small part of the central electrode is shielded by the grounding electrode. Thereby, mixed gas enters into the space between the grounding electrode and the central electrode rapidly so as to be ignited and then explode quickly to push the piston. Therefore, the piston can move reciprocally. Since the grounding electrode has a smaller volume, the generated spark has a large volume and absorbs a little thermal energy. Since electric discharging occurs in a tip point, the efficiency of ignition is high so as to improve the air to oil ratio in the cylinder and thus oil is saved and exhausted waste is reduced.

1 Claim, 5 Drawing Sheets

SPARK PLUG HAVING TAPERED GROUND ELECTRODE

FIELD OF THE INVENTION

The present invention relates to an ignition sparking plug, wherein the end of the grounding electrode in the ignition sparking plug near the central electrode is manufactured as a tip end so as to reduce the area in the central electrode to be shielded by the grounding electrode. Therefore, as the ignition sparking plug is used, the mixed gas within the cylinder can be burned rapidly, meanwhile, the material used is saved.

BACKGROUND OF THE INVENTION

With reference to FIG. 1, the ignition sparking plug 10 is assembled in the cylinder 11. By discharging between the central electrode 12 at one end thereof and the grounding electrode 13, an electric spark is generated so as to combust the mixing gas (formed by oil and air) in the cylinder 11 to cause an explosion. Therefore, the piston 110 is pushed away.

In practical operation, in two strokes of the engine, all the cylinders 11 must be operated one time. For an operation of 3000 revolutions per minutes (rpm), the engine revolves through 50 circles per second. In other words, each cylinder moves 25 times in each second. Thus, it should be understand that the actuation time of the ignition sparking plug is very short. In order that the explosion of the ignition sparking plug is more practical and is pushed smoothly, the mixing gas must enter into the space between the central electrode 12 and the grounding electrode 13 in a very short time (before explosion, the space within the cylinder is in a vacuum state, thus mixed gas necessarily enters into the space, and is ignited in the space between the central electrode and the grounding electrode). However, in general, the grounding electrode 13 of an ignition sparking plug 10 is a flat plate which shield the central electrode 12 completely. Thus, the mixed gas is very difficult to enter into the space between the central electrode 12 and the grounding electrode 13 in a very short time. As a result, the function of the ignition sparking plug 10 and the action of the cylinder 11 are affected. Therefore, many improvements are performed for improving such kind of prior art ignition sparking plug.

With reference to FIGS. 2 and 3, wherein a cruciform trench 14 or a V shape trench 15 is formed in the central electrode 12 so as to increase the space connected the central electrode 12 and the grounding electrode 13. Thus, by this enlarged space, the mixed gas can flow this space rapidly. Referring to FIG. 4, a trench 16 is formed at the inner surface of the grounding electrode 13 with respect to the central electrode 12 so as to increase the space between the central electrode 12 and the grounding electrode 13. Thus, mixed gas may enter into this space. Besides, referring to FIG. 5, the grounding electrode 13 is made with a shorter length for reducing the shielding of the central electrode 12 so that mixed gas enters into the space between the central electrode 12 and the grounding electrode 13 rapidly for explosion. With reference to FIG. 6, a hole 17 is drilled in the grounding electrode 17 with respect the central electrode 12 so that mixed gas can enter into the space between the central electrode 12 and the grounding electrode 13 rapidly for next explosion.

The above improvements is aimed at the mixed gas may enter into a predetermined space. However, in above designs, the grounding electrode 13 still shields the central electrode 12 with a large area. Moreover, due to the width of the grounding electrode 13, the mixed gas 13 must move around the two sides of the grounding electrode 13 for entering into the space between central electrode 12 and the grounding electrode 13. Similarly, the firing mixed gas must flow around the two sides of the grounding electrode 13 for extending the combustion outwards. Therefore, the traveling of the mixed gas is not straight. In a short ignition, the explosion of the mixed gas will not be smooth, therefore, although the aforesaid improvements have the effect of improving the function of the prior art ignition sparking plug 10, the effect is not preferred.

Besides, when the ignition sparking plug 10 is ignited to spark, since the area of the grounding electrode 13 is too large, it will absorb a larger thermal energy and the expansion of the spark is prevented. As a result, the range of the spark is hindered. Furthermore, when cool mixed gas enters into the space, the surface of the ignition sparking plug 10 will be cooled so that the surfaces of the central electrode 12 and grounding electrode 13 have no function of ignition. Therefore, a grounding electrode designed with a larger area can not improve the performance of the ignition. As oil only occupies a small part of the mixed gas, it is possible that no explosion occurs. Accordingly, the air gate must be closed for increasing the concentration of the oil. This not only wastes oil, but also an incomplete combustion occurs and coal will accumulate. Therefore, aforesaid ignition sparking plug is not met the practical requirement and is necessary to be improved further.

SUMMARY OF THE INVENTION

Accordingly, the primary object of the present invention is to provide an improved structure of an ignition sparking plug having a grounding electrode and a central electrode. The grounding electrode has a tip end with respect to the central electrode so that the only a small part of the central electrode is shielded by the grounding electrode. Thereby, mixed gas enters into the space between the grounding electrode and the central electrode rapidly so as to be ignited and then explode quickly to push the piston. Therefore, the piston can move reciprocally. Since the grounding electrode has a smaller volume, the generated spark has a large volume and absorbs a little thermal energy. Since electric discharging occurs in a tip point, the efficiency of ignition is high so as to improve the air to oil ratio in the cylinder and thus oil is saved and exhausted waste is reduced.

The various objects and advantages of the present invention will be more readily understood from the following detailed description when read in conjunction with the appended drawing.

DETAILED DESCRIPTION OF THE PREFERRED EMBODIMENTS

Figure 1:
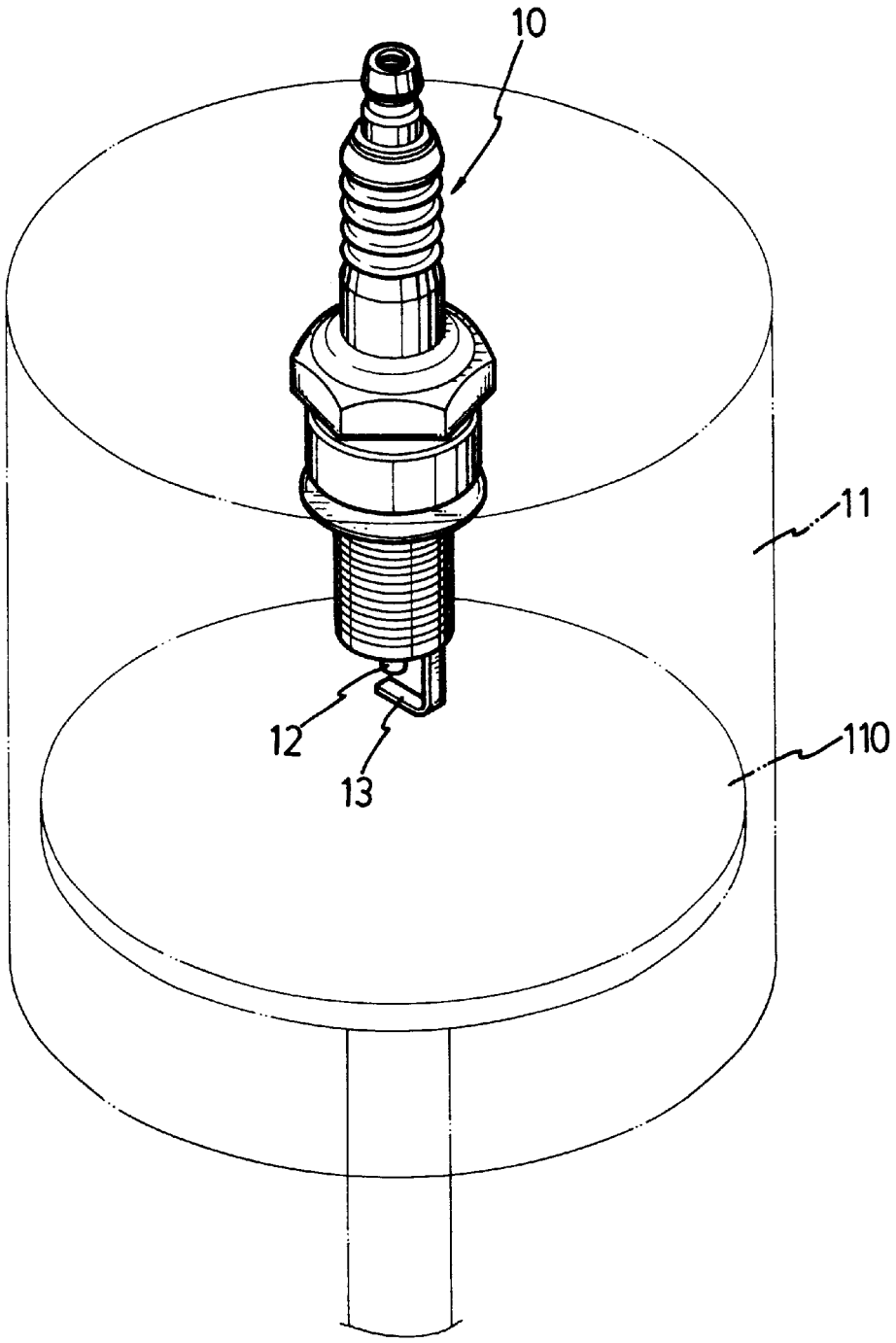
FIG. 1 is a schematic view of a prior art ignition sparking plug.
Figure 2:
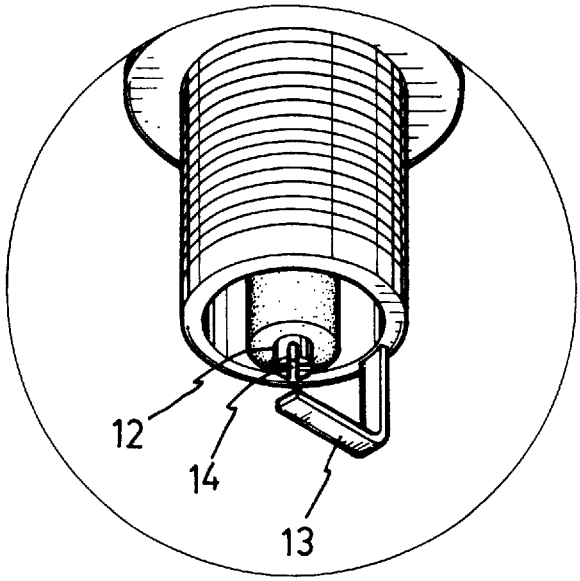
FIG. 2 illustrates a perspective view of an improved ignition sparking plug (1).
Figure 3:
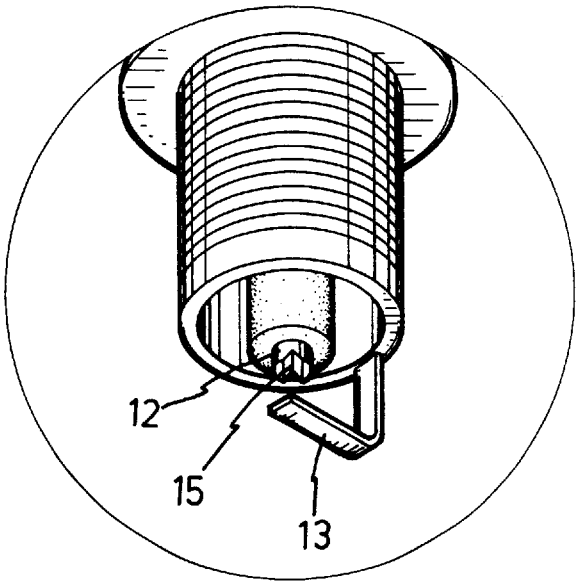
FIG. 3 illustrates a perspective view of an improved ignition sparking plug (2).
Figure 4:
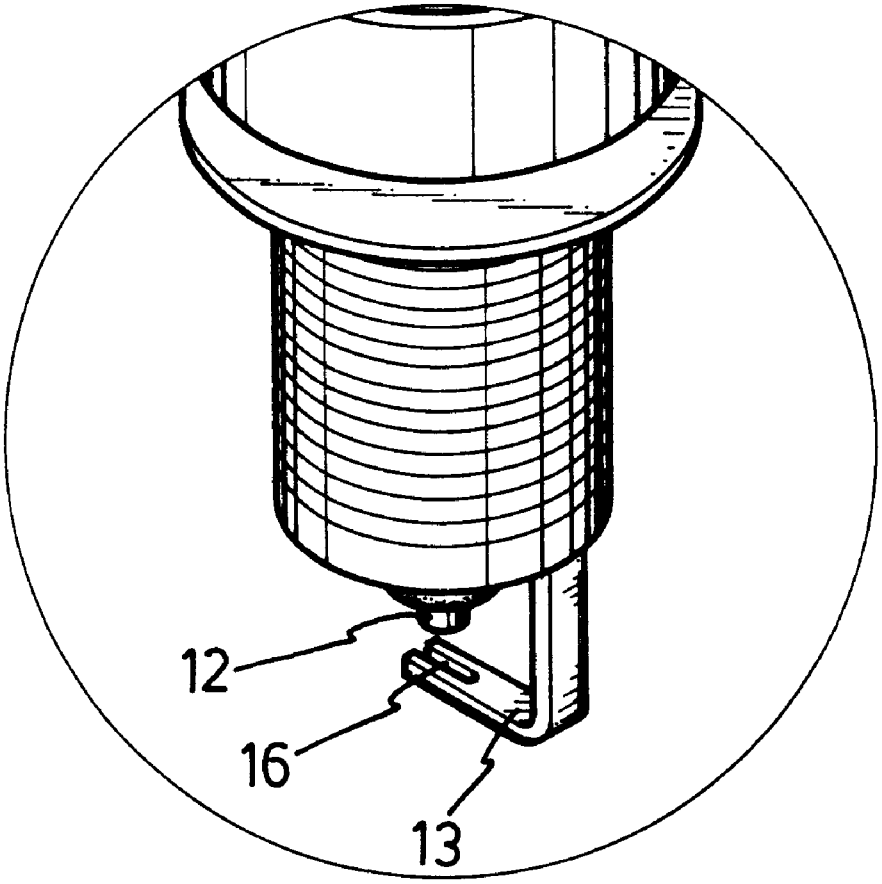
FIG. 4 illustrates a perspective view of an improved ignition sparking plug (3).
Figure 5:
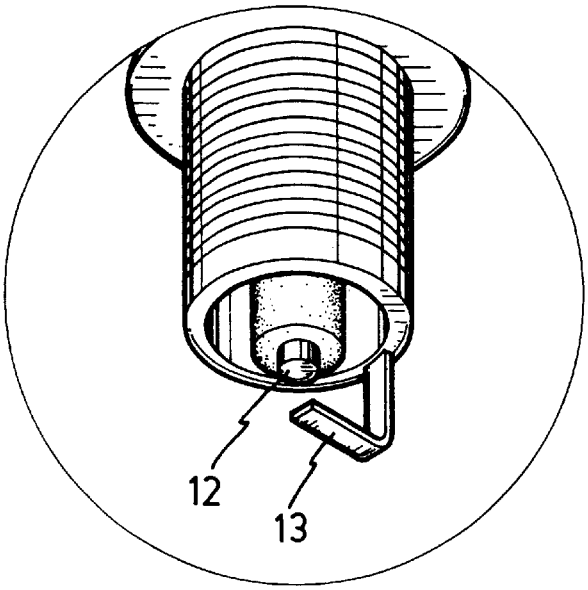
FIG. 5 illustrates a perspective view of an improved ignition sparking plug (4).
Figure 6:
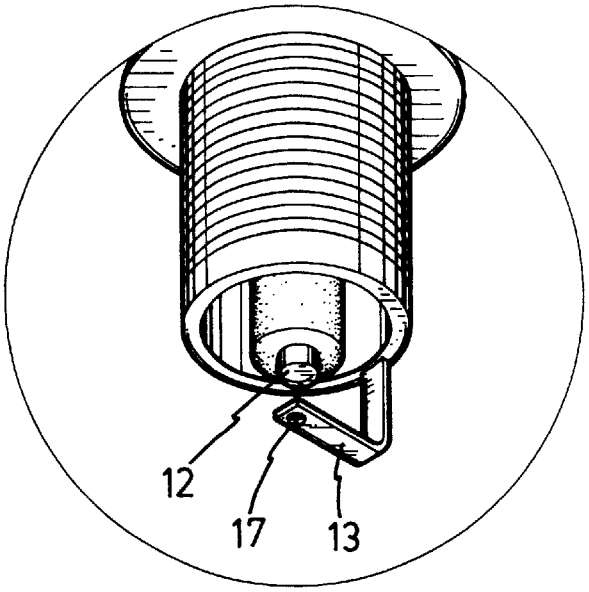
FIG. 6 illustrates a perspective view of an improved ignition sparking plug (5).
Figure 7:
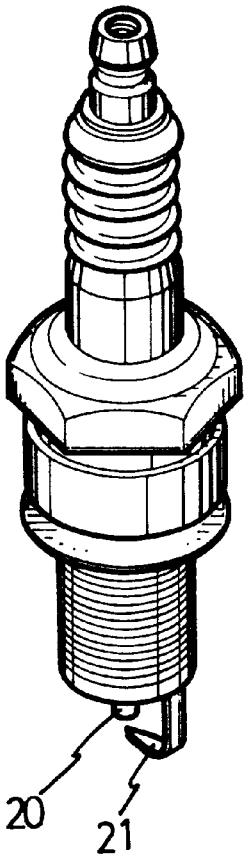
FIG. 7 shows a perspective view of the present invention.
Figure 8:
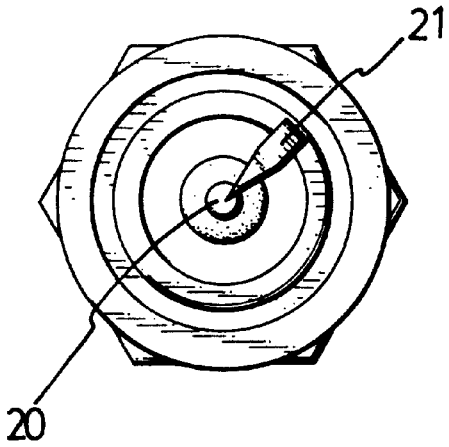
FIG. 8 is a plan schematic view of the present invention.

As shown in FIGS. 7 and 8, the ignition sparking plug of the present invention primarily includes a central electrode 20 and a grounding electrode 21. The end of the grounding electrode 21 with respect to the central electrode 20 is formed as a tip end so that the two sides of the grounding electrode 21 has greatly reduced areas with respect to the central electrode 20. The length of the grounding electrode 21 can be reduced so that the tip end thereof is correspondent to the center of the central electrode 20.

Therefore, since the area of the grounding electrode 21 correspondent to the central electrode 20 is smaller, and the grounding electrode 21 has a shorter length, the mixed gas can directly pass through the grounding electrode 21 to the central electrode 20, and therefore, in the traveling of the mixed gas, the present invention provides a rapid and smooth path. Comparing with the prior arts in which mixed gas must flow around the grounding electrode, the present invention is rapider and more practical. Another, when the mixed gas is ignited and thus combusted, the shielding of the grounding electrode 21 is smaller, the combustion can expand immediately, and the spark expands in a very short time and is more smooth so that a large explosion is induced. Consequently, the present invention is preferred that the prior art designs.

Besides, since the area of the grounding electrode 21 is reduced largely, during the process that the ignition sparking plug discharges to form a spark, less thermal energy is absorbed. Therefore, the efficiency of ignition of the ignition sparking plug is increased. As a result, is use, even the air to oil ratio is large (less oil in the mixed gas), the mixed gas can be ignited effectively. Not only the oil is saved, but also the resource is saved. The oil in the mixed gas is burned completely, and no coal accumulates.

Therefore, in the present invention, the grounding electrode has a tip end so that a large space is formed between the grounding electrode and the central electrode and is sufficiently filled with the mixed gas. By the present invention, even an air to oil ratio is large, the ignition still can be performed successfully.

Although the present invention has been described with reference to the preferred embodiments, it will be understood that the invention is not limited to the details described thereof. Various substitutions and modifications have been suggested in the foregoing description, and others will occur to those of ordinary skill in the art. Therefore, all such substitutions and modifications are intended to be embraced within the scope of the invention as defined in the appended claims.

What is claimed is:

1. An ignition sparking plug having a grounding electrode and a central electrode, wherein the grounding electrode has a distal end formed with a tip aligned with the central electrode so that only a small part of the central electrode is shielded by the grounding electrode, whereby, a mixed gas enters a space between the grounding electrode and the central electrode rapidly to be ignited and then exploded quickly; and wherein, the grounding electrode is shortened so that the tip of the distal end of the grounding electrode is exactly aligned with a central point of the central electrode.

* * * * *